US011457705B2

(12) United States Patent
Berger

(10) Patent No.: US 11,457,705 B2
(45) **Date of Patent: *Oct. 4, 2022**

(54) FOLDING TABLE

(71) Applicant: Aviad Berger, Rehovot (IL)

(72) Inventor: Aviad Berger, Rehovot (IL)

( * ) Notice: Subject to any disclaimer, the term of this patent is extended or adjusted under 35 U.S.C. 154(b) by 288 days.

This patent is subject to a terminal disclaimer.

(21) Appl. No.: 16/865,374

(22) Filed: May 3, 2020

(65) Prior Publication Data

US 2020/0253346 A1 Aug. 13, 2020

Related U.S. Application Data

(62) Division of application No. 16/132,437, filed on Sep. 16, 2018.

(60) Provisional application No. 62/569,885, filed on Oct. 9, 2017.

(51) Int. Cl.

| | |
|---|---|
| ***A45C 7/00*** | (2006.01) |
| ***A47B 3/08*** | (2006.01) |
| ***A45C 13/02*** | (2006.01) |
| ***A47B 3/10*** | (2006.01) |
| ***A47B 3/00*** | (2006.01) |
| *A47B 1/05* | (2006.01) |
| *A47B 13/10* | (2006.01) |

(52) U.S. Cl.

CPC ..... *A45C 7/0077* (2013.01); *A45C 13/02* (2013.01); *A47B 3/00* (2013.01); *A47B 3/08* (2013.01); *A47B 3/10* (2013.01); *A47B 1/05* (2013.01); *A47B 13/10* (2013.01)

(58) Field of Classification Search

CPC ..... A45C 7/0077; A45C 13/02

USPC ..... 108/147.19; 229/117.01; 383/2, 4, 38; 135/98, 99

See application file for complete search history.

(56) References Cited

U.S. PATENT DOCUMENTS

| | | | | | |
|---|---|---|---|---|---|
| 1,533,636 | A * | 4/1925 | Day | A45C 7/0077 | 5/99.1 |
| 3,392,534 | A * | 7/1968 | Blenkarn | E02B 17/021 | 108/115 |
| 3,715,996 | A * | 2/1973 | Rolfshus | A47C 9/00 | D6/692.3 |
| 5,676,168 | A * | 10/1997 | Price | E04H 15/40 | 135/125 |
| 5,979,976 | A * | 11/1999 | Ferencik | A47C 4/04 | 297/53 |
| 6,036,011 | A * | 3/2000 | DeCurtis | G06F 1/1628 | 190/18 R |
| 10,743,629 | B2 * | 8/2020 | Berger | A45C 13/02 | |
| D938,207 | S * | 12/2021 | Long | D6/686 | |

(Continued)

FOREIGN PATENT DOCUMENTS

| | | | | |
|---|---|---|---|---|
| CH | 709803 | A2 * | 12/2015 | A45C 13/008 |
| GB | 2527750 | A * | 1/2016 | A45C 3/04 |

*Primary Examiner* — Jose V Chen

(57) ABSTRACT

A folding table, including a collapsible plurality of compressible hollow sections, each section able to be compressed and slid into an adjacent section for compact storage, and each section able to be slid out of an adjacent section and expanded so as to form a table top, a plurality of flexible legs, each leg including compressible portions, each portion able to be compressed and pushed into an adjacent portion, and compartments within the sections for rotating the legs therein when the portions of the legs are pushed one into another, to store the legs.

7 Claims, 14 Drawing Sheets

(56) References Cited

U.S. PATENT DOCUMENTS

| | | | | |
|---|---|---|---|---|
| 2003/0015527 | A1* | 1/2003 | Schneider | A45C 7/0077 220/9.2 |
| 2003/0183629 | A1* | 10/2003 | Wang | B65D 21/086 220/9.2 |
| 2003/0218039 | A1* | 11/2003 | Abel | A45F 3/04 224/656 |
| 2007/0131683 | A1* | 6/2007 | Sabounjian | A45C 7/0077 220/9.1 |
| 2008/0056625 | A1* | 3/2008 | Stanton | B65F 1/0006 220/9.3 |
| 2011/0174811 | A1* | 7/2011 | Sabounjian | D06F 95/002 220/9.2 |
| 2012/0060881 | A1* | 3/2012 | Ly-Cho | E04H 15/405 135/121 |
| 2018/0368545 | A1* | 12/2018 | Seegmiller | A45C 13/02 |

* cited by examiner

FOLDING TABLE

PRIORITY REFERENCE TO PROVISIONAL APPLICATION

This application claims benefit of and hereby incorporates by reference U.S. Provisional Application No. 62/569,885, entitled FOLDING PACK BAG AND FOLDING TABLE, and filed on Oct. 9, 2017 by inventor Aviad Berger.

FIELD OF THE INVENTION

The present invention relates to a pack bag and a table that fold very compactly when not in use, and that expand to a large size when in use.

BACKGROUND OF THE INVENTION

With ever-decreasing limitations on space for travelers, there is a need and a technical challenge of manufacturing packing bags, tables, and other travel articles that fold as compactly as possible, and open as easily as possible, similar to tents.

SUMMARY OF THE DESCRIPTION

Embodiments of the present invention relate to:

(i) a pack bag that opens and folds using a mechanism similar to that of an umbrella. The bag stows in a very compact form when it is empty, and opens when necessary to pack it with content; and (ii) a table that folds to a small size so that it may be carried compactly.

There is thus provided in accordance with an embodiment of the present invention a compartmentalized folding bag, including an outer cover enclosing one or more cylindrical storage compartments, an inner cover including a hollow cylinder passing through the storage compartments, a spine inside the inner cover, operative to raise and lower, causing the bag to raise and lower vertically, and operative to open and close, causing the bag to expand and compress radially, and a locking mechanism that locks to hold the spine in its raised expanded position and that unlocks to pull the spine back to its lowered compressed position.

There is additionally provided in accordance with an embodiment of the present invention a folding table, including a collapsible plurality of compressible hollow sections, each section able to be compressed and slid into an adjacent section for compact storage, and each section able to be slid out of an adjacent section and expanded so as to form a table top, a plurality of flexible legs, each leg including compressible portions, each portion able to be compressed and pushed into an adjacent portion, and compartments within in the sections for rotating the legs therein when the portions of the legs are pushed one into another, to store the legs.

BRIEF DESCRIPTION OF THE DRAWINGS

The present invention will be more fully understood and appreciated from the following detailed description, taken in conjunction with the drawings in which.

For reference to the figures, the following index of elements and their numerals is provided. Similarly numbered elements represent elements of the same type, but they need not be identical elements.

Table of elements in the figures

| Element | Description |
|---|---|
| 100 | top cylinder of spine for bag |
| 101 | top opening |
| 102 | bottom ring |
| 103 | top rings |
| 104 | fixed tapered guide block |
| 105 | rope used to open the bag |
| 106 | rope used to fold the bag |
| 107 | guide poles |
| 108 | main pole |
| 109 | opening at top side of cylinder |
| 110 | adjustable rectangular frame to fit around guide block |
| 111 | joints |
| 112 | spring |
| 113 | slideable protrusion |
| 200 | spine |
| 201 | lower cylinders of spine |
| 202 | compacted top and lower cylinders |
| 203 | ropes connecting cylinders |
| 204 | spring |
| 205 | annulus protrusions |
| 206 | ring protrusions |
| 207 | seal |
| 300 | bag |
| 301 | bottom compartment |
| 302 | top compartment |
| 303 | inner cylinder |
| 304 | outer cylinder |

-continued

Table of elements in the figures

| Element | Description |
|---|---|
| 305 | separators |
| 306 | top/bottom of bag |
| 307 | connectors of spine and bag |
| 308 | zipper |
| 309 | opening at top of outer cylinder |
| 310 | opening at top of inner cylinder |
| 400 | folding table |
| 401 | table portions |
| 402 | leg portions |
| 403 | triangular elements to lock the leg inside its cell |
| 404 | wheel |
| 405 | spring |

DETAILED DESCRIPTION

Folding Pack Bag

Embodiments of the present invention relate to a pack bag that opens and folds using a mechanism similar to that of an umbrella. The bag stows in a very compact form when it is empty, and opens when necessary to pack it with content.

The ensuing description includes three sections; namely, two sections describing the spine/skeleton of the bag, and one section describing the cover of the bag.

As described in detail below with reference to FIGS. 5 and 9, the spine of the bag is built up from hollow cylinders. The cylinders compress slightly, so as to slide one into another in a telescopic manner, when the bag is folded. When the bag is opened the cylinders move out of one another and expand slightly, one cylinder sitting on top of the another so as to form a uniform column of cylinders; and two poles move up and out of the top cylinder and adjust themselves horizontally, to be perpendicular to the top cylinder.

I. Top Cylinder of the Spine

The description now proceeds to the top uppermost cylinder of the spine.

Figure 1:
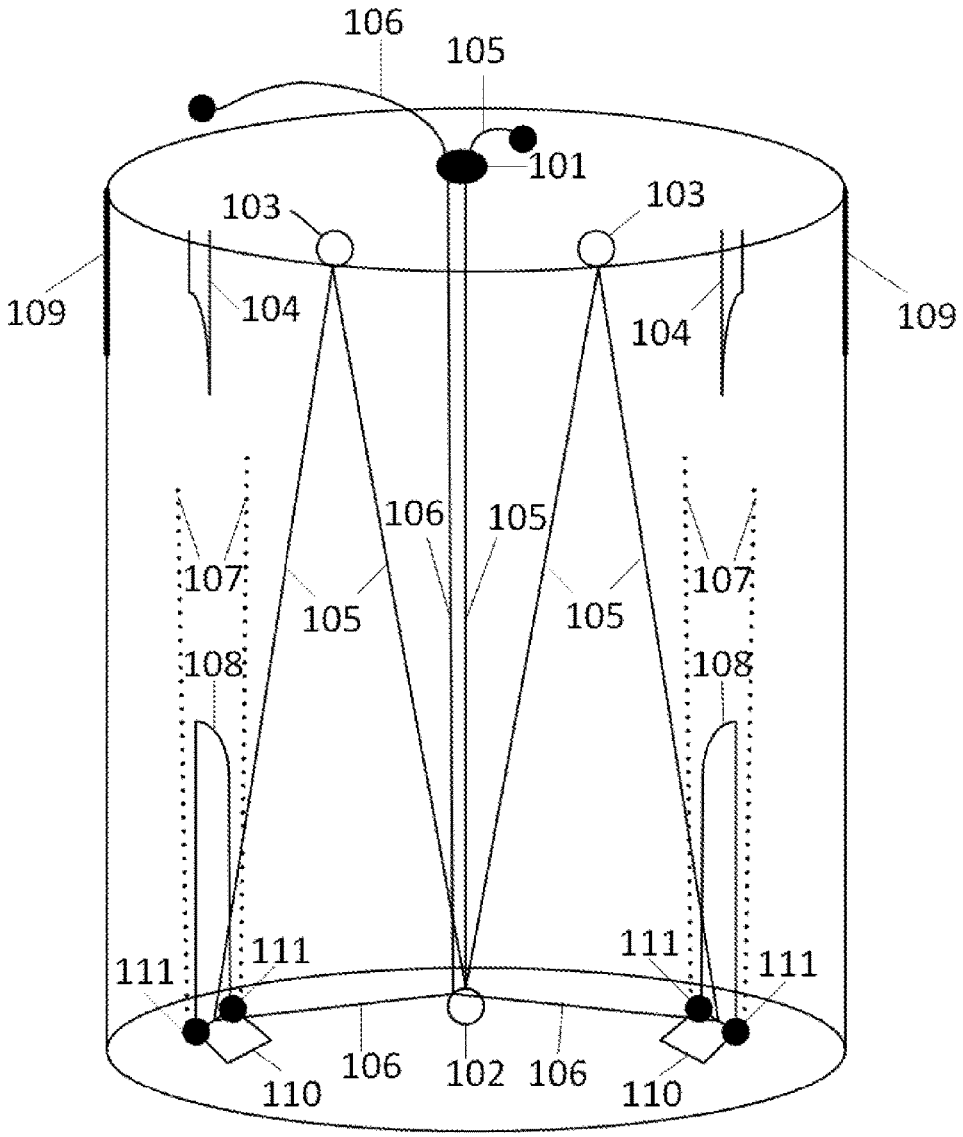
FIG. 1 is a simplified diagram of a top cylinder of a spine for a folding bag, the top cylinder being in a closed position, in accordance with an embodiment of the present invention.

Reference is made to FIG. 1, which is a simplified diagram of a top cylinder 100 of a spine for a folding bag, top cylinder 100 being in a closed position, in accordance with an embodiment of the present invention. As shown in FIG. 1, there are two poles 108 in the bottom sides of cylinder 100. When the bag is opened, poles 108 move up and slide out of cylinder 100 through two slits 109 on the top sides of cylinder 100. Poles 108 are directed by fixed tapered blocks 104 on the top sides of cylinder 100, and are locked into place horizontally by flat parts of tapered blocks 104. The rounded edges of poles 108 are shaped to complement the tapering of blocks 104.

Two ropes, 105 and 106, are attached to the bottom of each pole 108. Rope 105 goes up to a ring 103 on the top of cylinder 100 near tapered block 104 and then down to a ring 102 at the bottom of cylinder 100 at its center, and then up again through an opening 101 at the top of cylinder 100 at its center. Rope 106 goes straight through ring 102 and up through opening 101. This way, pulling of rope 105 causes pole 108 to move upwards, and pulling of rope 106 causes pole 108 to move back down again.

Each pole 108 includes an adjustable frame 110 which latches around tapered block 104 when pole 108 is pulled up, and includes pivot joints 111.

It will be appreciated by those skilled in the art that the use of two poles 108 in FIG. 1 is merely an exemplary configuration, and the instant invention contemplates that cylinder 100 may include three or more such poles 108 distributed around cylinder 100. In generally, each pole has two ropes attached to the bottom of the pole. A first one of the two ropes is connected, after going through bottom ring 102, to a first common rope for opening the spine; and a second one of the two ropes is connected at bottom ring 102 to a second common rope for closing the spine.

Shown in FIG. 1 next to each pole 108 are two broken lines. These lines represent two fixed guides 107, such as metal guides, to guide pole 108 upwards. Guidance of pole 108 may alternatively or additionally be achieved by use of a chain of half-rings, one on top of the other protruding from the surface of cylinder 100.

Figure 2:
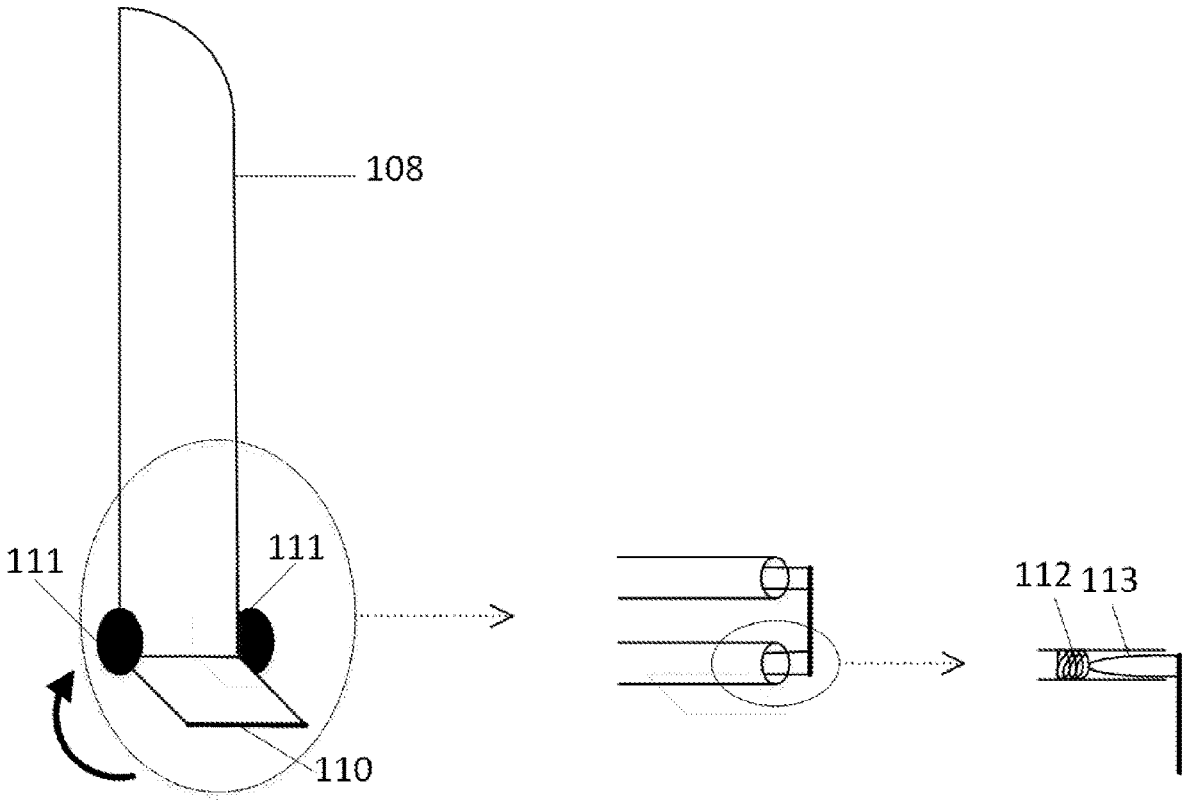
FIG. 2 is a simplified enlarged diagram of an adjustable frame attached to a pole of the top cylinder, in accordance with an embodiment of the present invention.

Reference is made to FIG. 2, which is a simplified enlarged diagram of adjustable frame 110 attached to pole 108 of top cylinder 100, in accordance with an embodiment of the present invention. At the bottom of pole 108 is a rectangular frame 110 that elongates when it latches around and slides up tapered block 104. Pivot joints 111 enable frame 110 to turn from being perpendicular to pole 108, to being parallel to pole 108, where the resting position of frame 110 is the perpendicular position. FIG. 2 shows a spring mechanism, with a spring 112 and a protrusion 113, that enables one of the sides of frame 110 to be pulled outwards, thus elongating frame 110, when pole 108 is pulled up and frame 110 latches around and slides up tapered block 104. Frame 110 slides up through the edges of tapered block 104 as pole 108 moves upwards. As pole 108 continues moving up, frame 110 elongates rectangularly, and when pole 108 turns horizontally perpendicular to top cylinder 100, frame 110 likewise pivots parallel to pole 108. This elongating and pivoting of frame 110 serves to lock pole 108 into the horizontal position when the bag is open.

Figure 3:
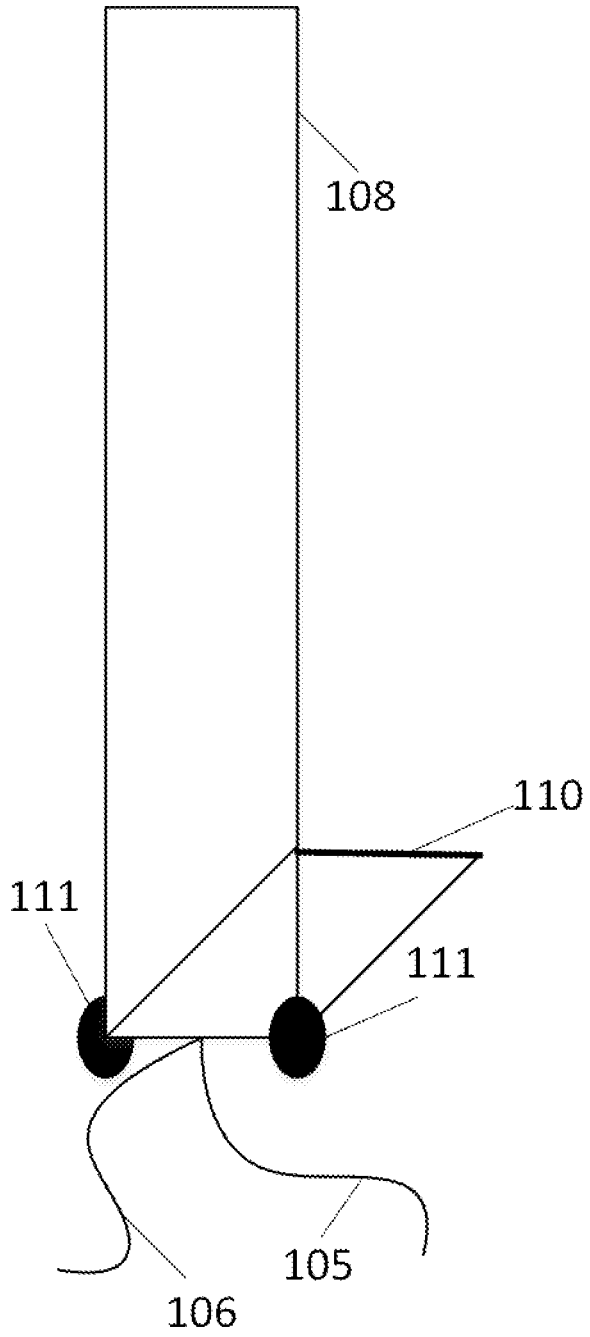
FIG. 3 is a simplified enlarged diagram of a pole of the top cylinder, in accordance with an embodiment of the present invention.

Reference is made to FIG. 3, which is a simplified enlarged diagram of pole 108 of top cylinder 100, in accordance with an embodiment of the present invention. FIG. 3 shows ropes 105 and 106 attached to the bottom of pole 108. Rope 105, which opens the bag, pulls pole 108 upwards, and rope 106, which closes the bag, pulls pole 108 downwards.

Figure 4:
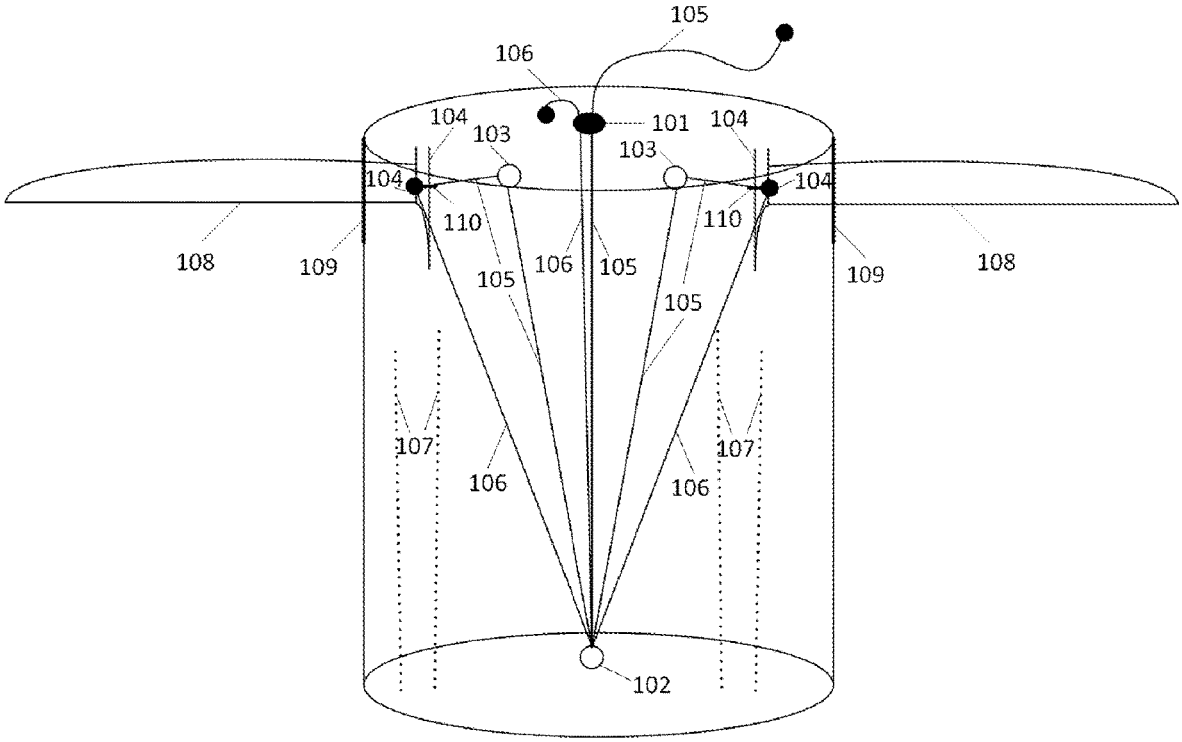
FIG. 4 is a simplified diagram of a top cylinder of a spine for a folding bag, the top cylinder being in an open position, in accordance with an embodiment of the present invention.

Reference is made to FIG. 4, which is a simplified diagram of top cylinder 100 in an open position, in accordance with an embodiment of the present invention. As shown in FIG. 4, when the bag is open, poles 108 face outwards, frames 110 are latched around tapered blocks 104, and ropes 105 and 106 are pulled all the way up to frames 110. Rope 105 goes through ring 103 at the top of cylinder 100, then through ring 102 at the bottom of cylinder 100, and then out of cylinder 100 through opening 101 at the top of cylinder 100. Rope 106 goes through ring 102 at the bottom of cylinder 100 and then out of cylinder 100 through opening 101 at the top of cylinder 100.

II. Lower Cylinders of the Spine

The description now proceeds to the lower cylinders of the spine.

As mentioned above, the spine of the bag is built out of cylinders that pull out from being one inside another to being one on top of another. As such, when the bag is folded the cylinders are compressed radially, such that the radius of each lower cylinder of the spine is slightly larger than the radius of the cylinder above it.

Figure 5:
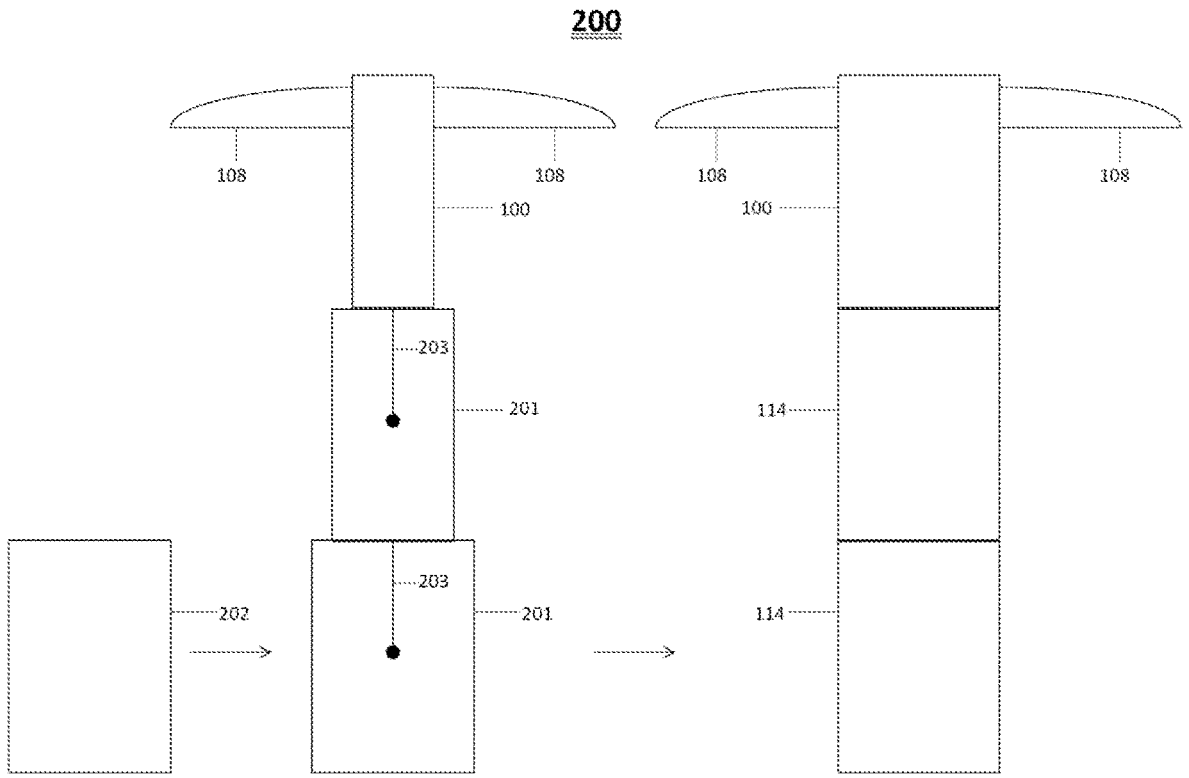
FIG. 5 is a simplified diagram of the spine for the folding bag, in accordance with an embodiment of the present invention.

Reference is made to FIG. 5, which is a simplified diagram of a spine 200 for the folding bag, in accordance with an embodiment of the present invention. At the left, FIG. 5 shows the cylinders of spine 200 in a compacted configuration 202, one cylinder inside another. In the middle, FIG. 5 shows the cylinders of spine 200, each cylinder pulled out of another in their radially compressed states. Spine 200 includes lower cylinders 201, and top cylinder 100. At the right, FIG. 5 shows the cylinders expanded radially so as to form a uniform column of cylinders.

As shown in FIG. 5, from inside each lower cylinder 201 there is attached a rope 203 in the center going to the bottom of the cylinder above it, from the inside. Rope 203 prevents separation of the cylinders. Pulling on rope 105 from outside of top cylinder 100, causes poles 108 to be pulled up and out of top cylinder 100, and also causes the lower cylinders to be pulled one out of another. It will be appreciated by those skilled in the art that use of one rope 105 to open the bag is merely exemplary, and the instant invention contemplates that there may be more than one rope to open the bag. When a cylinder of spine 200 is pulled out of the cylinder beneath it, the upper cylinder expands radially so as to have the same radius as the bottom cylinder. Since the cylinders are attached with ropes 203, they line up one on top of the other as shown at the right of FIG. 5. Squeezing on the cylinders, such as with one's hands, compresses the cylinders' radii, thus allowing them to slide down one into another. In their compressed state, each cylinder has a radius slightly smaller than the radius of the cylinder below it, in order for the cylinders to fit one inside another.

Figure 6:
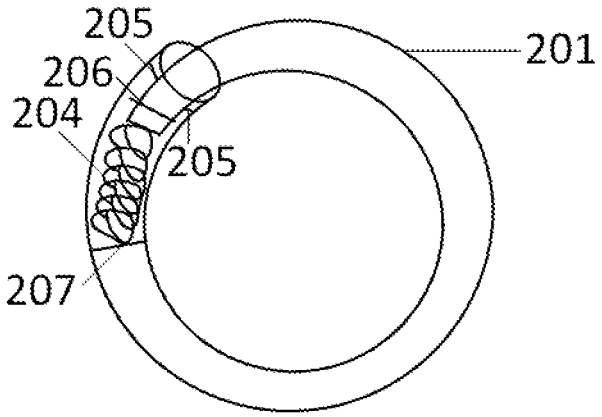
FIG. 6 is a view from above of a compressible cylinder of the folding bag, in accordance with an embodiment of the present invention.

Reference is made to FIG. 6, which is a view from above of a compressible cylinder of the folding bag, in accordance with an embodiment of the present invention. The cylinder's perimeter is made up of a hose-like unit that wraps around the perimeter slightly more than 360°. One edge of the hose is closed and passes through the other edge which is open. There are annular protrusions 206 at the end of the closed edge and ring protrusions 205 at the end of the open edge. Ring protrusions 205 cannot pass through annular protrusions 206. Thus separation of the edges, which would open the hose, is prevented. There is a spring 204 in the open edge mounted on a seal 107 of the hose, that pushes on the closed edge of the hose. When spring 204 is free to expand, the cylinder is free to enlarge to its maximum radius; i.e., to the radius of the bottom cylinder.

III. Cover of the Bag

The description now proceeds to the cover of the bag.

Figure 7:
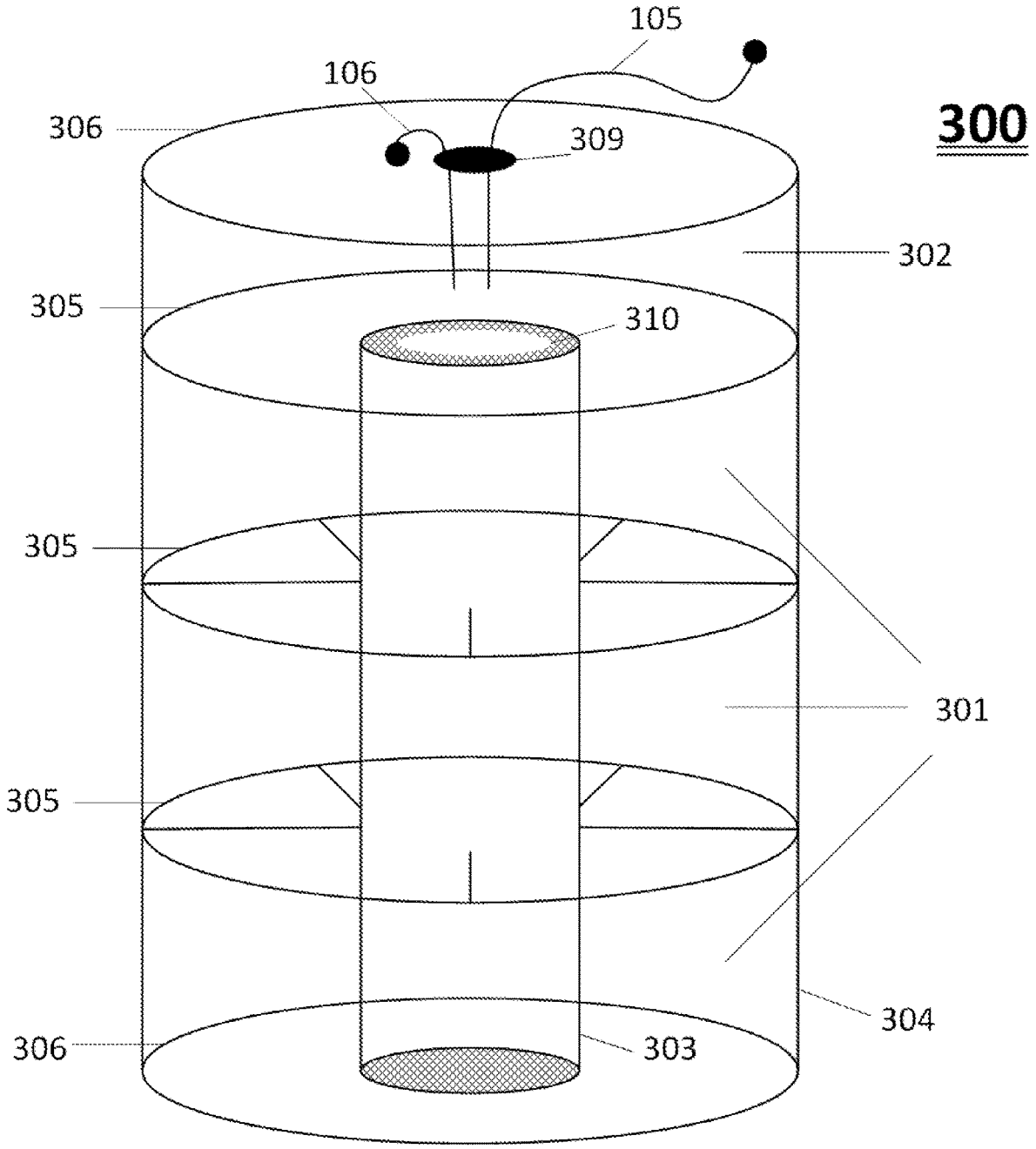
FIG. 7 is a simplified diagram of the interior and exterior of the bag, in accordance with an embodiment of the present invention.

The cover is made of cloth or other material that can hold weight and be folded. Reference is made to FIG. 7, which is a simplified diagram of the interior and exterior of a folding bag 300, in accordance with an embodiment of the present invention. As shown in FIG. 7, bag 300 has an inner cover 303 that contains spine 200, and an outer cover 304 that holds contents of the bag. Bag 300 has two floors. A bottom floor includes three compartments 301 of uniform height. Two separators 305 separate the volume into three compartments. The space of the three compartments is for storage. A top floor includes a cylinder 302 with the same radius as that of the compartments, but with a smaller height.

Inner cover 303 has an opening 310 through which the topmost cylinder of spine 200 passes. I.e., the topmost cylinder of spine 200 is situated between the top of inner cover 303 and the top of the outer cover 304, and the rest of spine 200 is situated inside of inner cover 303.

Figure 8:
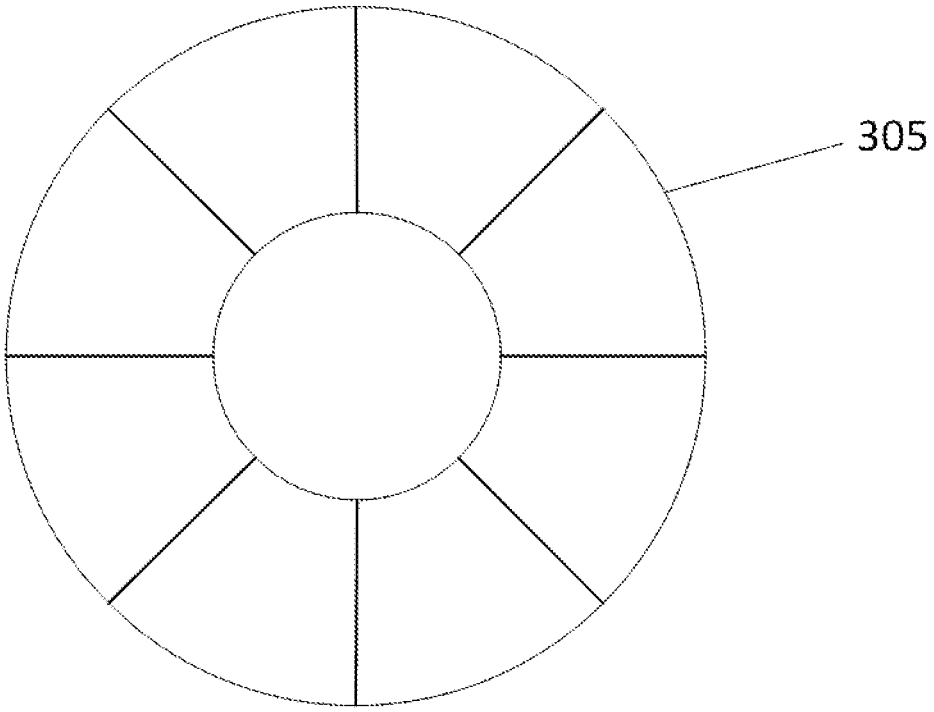
FIG. 8 is a simplified diagram of a separator for the lower compartments of the bag, in accordance with an embodiment of the present invention.

Reference is made to FIG. 8, which is a simplified diagram of separator 305 for lower compartments 301 of bag 300, in accordance with an embodiment of the present invention.

Figure 9:
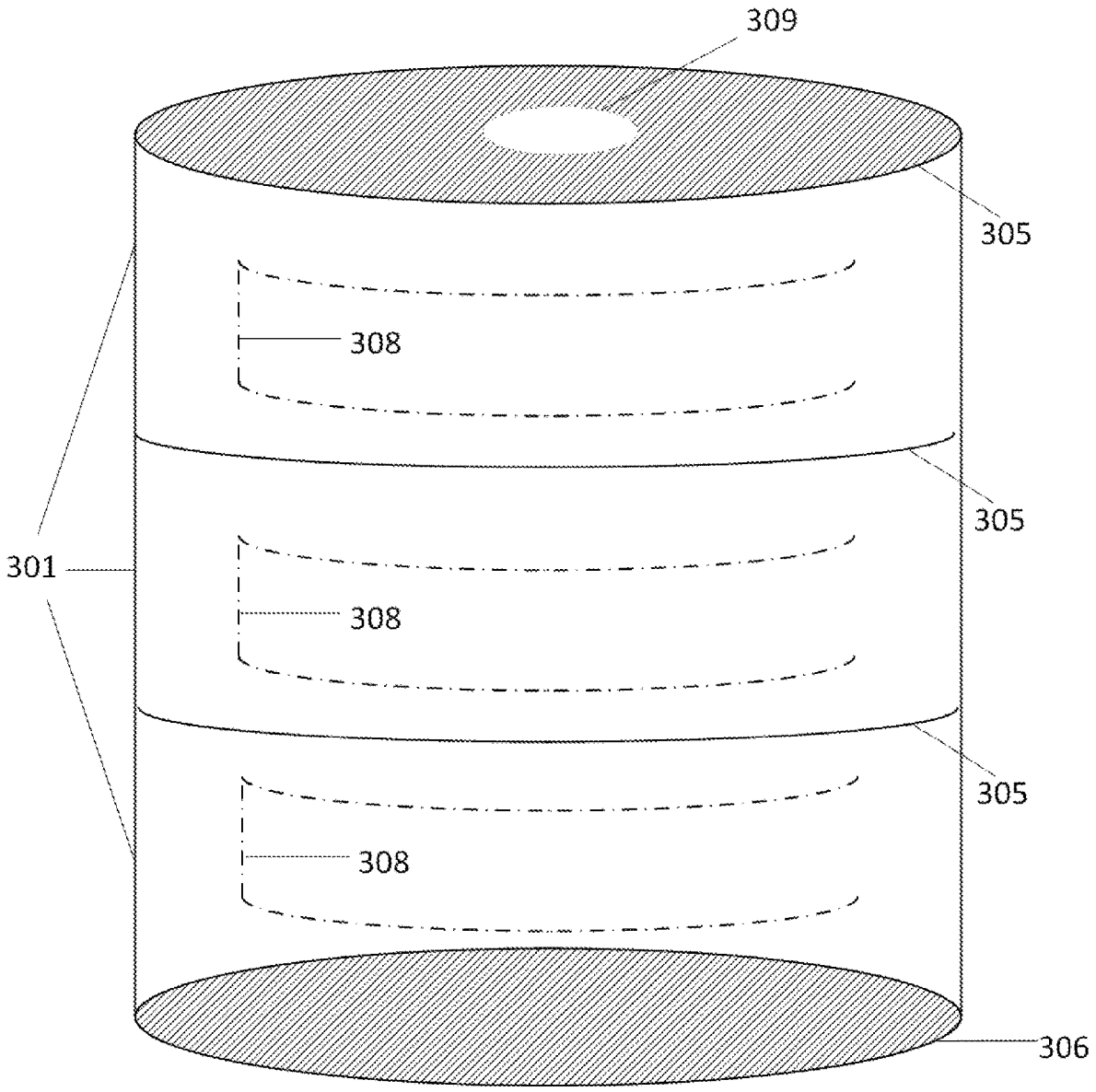
FIG. 9 is a simplified diagram of a front view showing how the spine fits inside the bag, in accordance with an embodiment of the present invention.

Reference is made to FIG. 9, which is a simplified diagram of an outside view of bag 300, in accordance with an embodiment of the present invention. As shown in FIG. 9, in order to access the storage area of bag 300 there are three openings 308 of bag 300, which are opened using scotch or zippers to create openings into the three compartments of the bottom floor 301 of the outer cover mentioned earlier.

Figure 10:
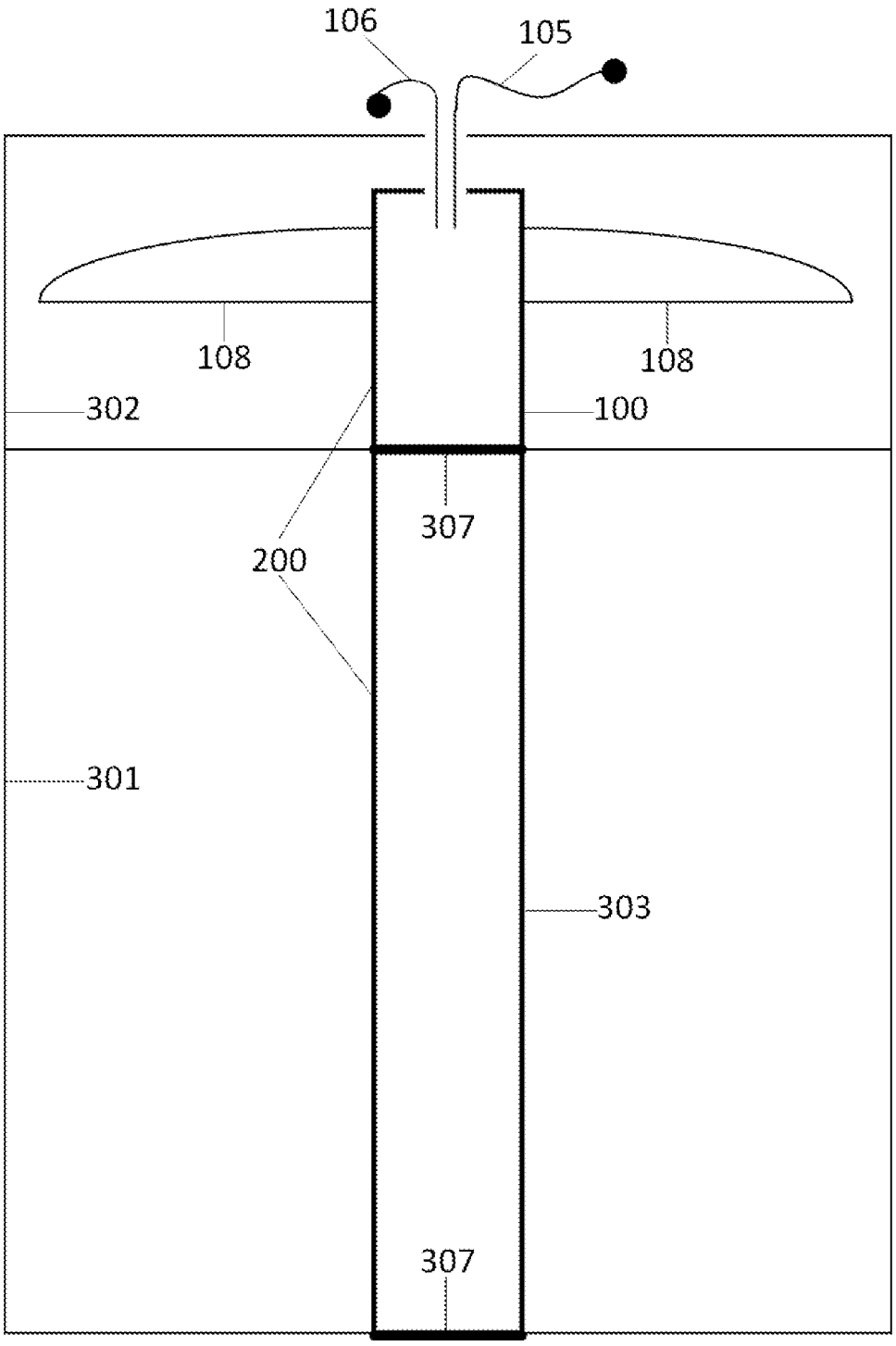
FIG. 10 is a simplified diagram of an outside view of the bag, in accordance with an embodiment of the present invention.

Reference is made to FIG. 10, which is a simplified diagram of a front view showing how spine 200 fits inside bag 300, in accordance with an embodiment of the present invention. As shown in FIG. 10, spine 200 of bag 300 is contained inside inner cover 303. Spine 200 and outer cover 304 are attached at two places 307, shown bolded in FIG. 10. The bottom cylinder of spine 200 is attached to an area 306 (FIG. 7) at the bottom of outer cover 304, and the bottom of top cylinder 100 of spine 200 is attached to the top of bottom floor 301 of outer cover 304. The two poles 108 protrude out of top cylinder 100 at the top of outer cover 304.

To fold bag 300, rope 106 is pulled, which causes poles 108 to retract back into spine 200. The cloth outer cover 304 is then pushed inwards to surround inner cover 303. By squeezing the folded bag, the cylinders in spine 200 compress and collapse down to all be within the bottommost cylinder of spine 200. The entire bag is then folded downward to surround the bottommost cylinder of spine 200. One of the ropes 105 or 106 that comes out through opening 101 of spine 200 and a top opening 309 of outer cover 304 may be used to tie the bag that is now folded.

It will thus be appreciated that embodiments of the present invention provide a bag 300 that can be folded to a size of a folded umbrella. Such compact folding allows people to carry an extra bag with them in a compact way and use it when needed.

Folding Table

Embodiments of the present invention also relate to a table that folds to a small size so that is may be carried compactly.

As described hereinbelow with reference FIG. 13, the legs of the table fold in a telescopic way, similar to how cylinders 201 and 100 fold together as described hereinabove in the folding bag embodiment (FIG. 5). After the legs are folded the body of the table folds again into itself in a telescopic way. As such, this embodiment has two parts, the legs and the body of the table.

Figure 11:
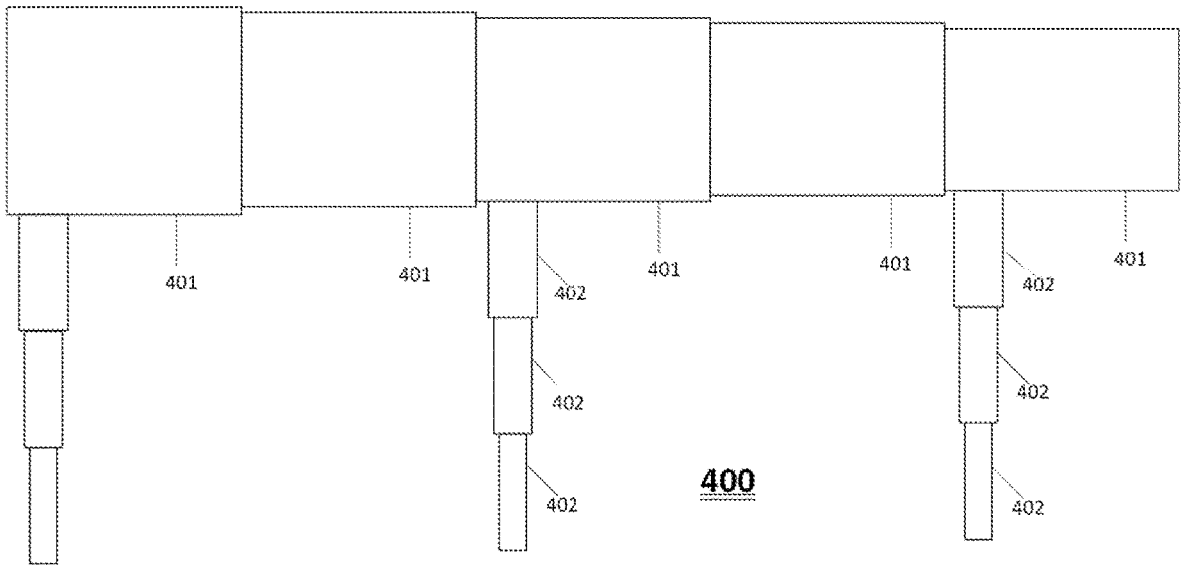
FIG. 11 is a simplified diagram of a rectangular folding table, in accordance with an embodiment of the present invention.

Reference is made to FIG. 11, which is a simplified diagram of a folding table 400, in accordance with an embodiment of the present invention. FIG. 11 shows table portions 401 that fold one into another when table 400 is in its stowed position. FIG. 11 also shows legs 402 of table 400. Portions 401 of the table slide out of one another to form a rectangular table top.

Figure 12:
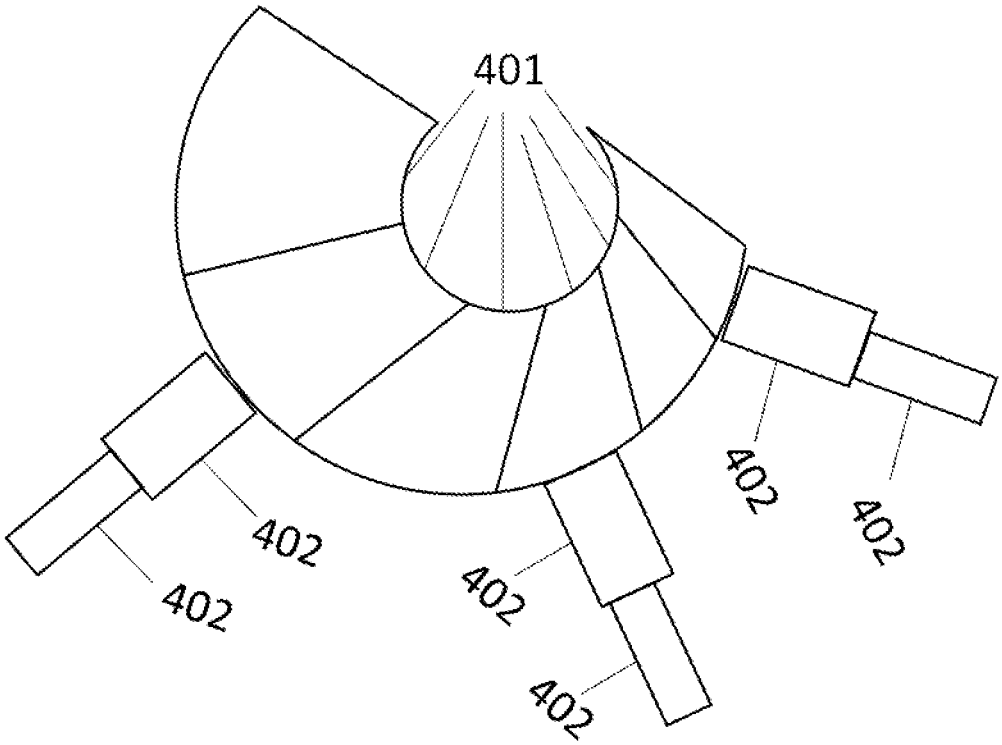
FIG. 12 is a simplified diagram of a circular folding table, in accordance with an embodiment of the present invention.

Reference is made to FIG. 12, which is a simplified diagram of a circular folding table 400, in accordance with an embodiment of the present invention. Table 400 of FIG. 12 opens using the same mechanism described hereinabove in the folding bag embodiment. Specifically, referring again to FIG. 6, a hose-like unit circles around the perimeter of each table portion, and a closed edge of the hose passes through an opening at the other edge of the hose. There are annular protrusions 206 at the end of the closed edge and ring protrusions 205 at the end of the open edge to prevent separation of the edges. There is a spring 204 in the open edge mounted on 207 a seal. Spring 204 pushes on the closed edge so that when a table portion is free to expand it automatically expands to its maximum radius; namely, the radius of the first table portion. From inside each table portion is attached a rope 203 in the center going to the end of the portion immediately adjacent to it, from the inside. Rope 203 prevents separation of the table portions. When a portion is pulled up out of the portion adjacent to it, the pulled-out portion expands radially to have the same radius as the first portion. Since the portion are all attached with ropes 203 they line up one adjacent to the other to form a uniform table top, as shown at the right of FIG. 5. Squeezing the table portions, such as with one's hands, shrinks their radii and allows the portions to slide back into one another, where a compressed portion has a slightly smaller radius than the radius of the portion immediately before it, in order for the portions to fit inside one another.

It is possible for table 400 to open and form a half circular table top, or table 400 can open straight to form a rectangular table top.

Figure 13:
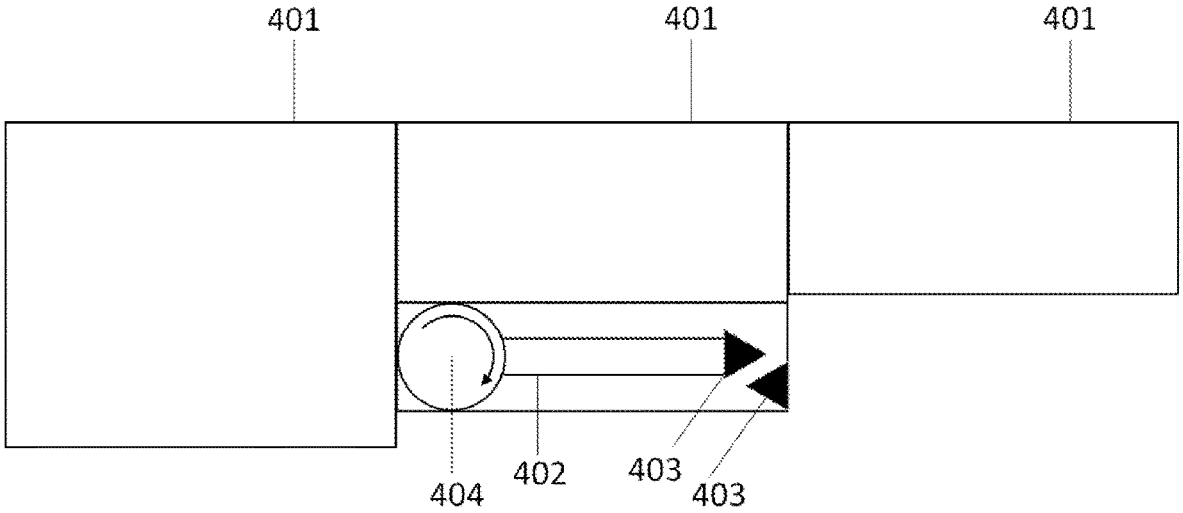
FIG. 13 is a simplified diagram of a folded and locked leg of the table, in accordance with an alternate embodiment of the present invention.

Reference is made to FIG. 13, which is a simplified diagram of a folded and locked leg 402 of table 400, in accordance with an embodiment of the present invention. A wheel 404 enables leg 402 to turn from its unlocked position to its locked position, and vice versa. Opposing triangular blocks 403 prevent leg 402 from opening unintentionally.

FIG. 13 shows the body of table 400 rotated 180°. There is a rectangular box where leg 402 sits when folded. The side of this box facing outward is open, for leg 402 to turn out through. At the top of the leg there is a wheel that allows the leg to rotate inwards and outwards up to 90°. At the bottom of leg 402 are two triangular blocks 403, one connected to leg 402 and the other connected to the box. Triangular blocks 403 serve to lock leg 402 in its box, in its folded state. Applying force on leg 402 to turn it via wheel 404 on its rotational path separates the bottom of leg 402 from the table body; i.e., the two triangular blocks 403 allow leg 402 to rotate freely. The box of table 400 that leg 402 lies in when folded is attached to the portion above to it, and together the box and the table portion slide into the previous table portion.

Figure 14:
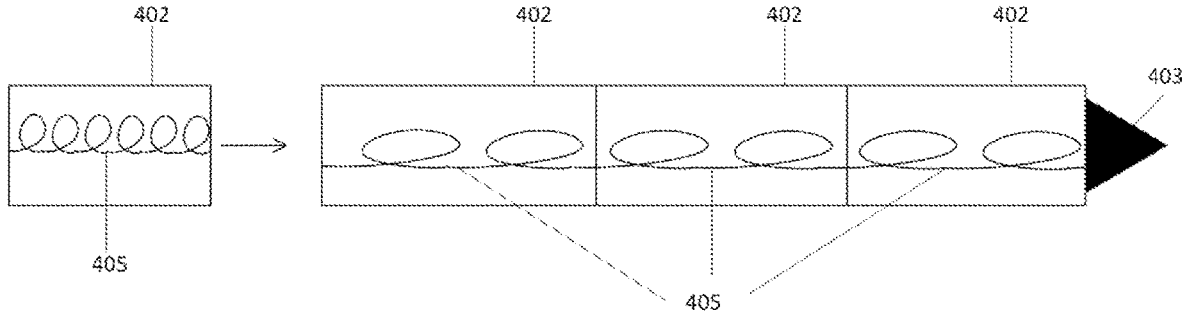
FIG. 14 is a simplified diagram of a table leg in an unfolded and a folded position, in accordance with an alternate embodiment of the present invention.

Reference is made to FIG. 14, which is a simplified diagram of a table leg 402 in an unfolded and a folded position, in accordance with an alternate embodiment of the present invention. In the embodiment of FIG. 14 there is a spring going from the top to the bottom of leg 402 that pulls leg 402 closed, thus providing an assist to close leg 402. FIG. 14 shows how leg 402 of table 400 opens in a similar way to the mechanism that opens the compartments in the folding bag embodiment with reference to FIG. 5.

To fold table 400, each leg portion is squeezed so that the leg portions compress and rise into the topmost leg portion. The folded legs 402 are then turned into their rectangular boxes, as shown in FIG. 13. Finally, table portions 401 are squeezed so that they compress and all insert within the first table portion.

It will thus be appreciated that embodiments of the present invention provide a table 400 that can be folded compactly, enabling people to carry the table with them in a compact way and use it as needed.

It will be appreciated by those skilled in the art that the subject invention has widespread application to other travel items, in addition to a pack bag and a table.

In the foregoing specification, the invention has been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed is:

1. A folding table, comprising:

a collapsible plurality of compressible hollowed-out sections, each section able to be compressed and slid into an adjacent section for compact storage, and each section able to be slid out of an adjacent section and expanded so as to form a table top;

a plurality of flexible legs, each leg comprising compressible portions, each portion able to be compressed and pushed into an adjacent portion; and compartments within said sections for rotating said legs therein using said wheel, when the portions of the legs are pushed one into another, to store said legs.

2. The folding table of claim 1 wherein each said compartment comprises a wheel for rotating a leg of the table in and out of the compartment.

3. The folding table of claim 1, wherein the legs comprise a linear spring for collapsing the leg portions when squeezed, and for expanding the leg portions when released.

4. The folding table of claim 1, wherein each leg portion comprises a spring that causes the leg portion, when pulled out of a larger adjacent leg portion, to expand radially so as to have a same radius as a topmost leg portion.

5. The folding table of claim 1 further comprising a locking mechanism for holding the legs in the compartments.

6. The folding table of claim 1 wherein the table top is rectangular.

7. The folding table of claim 1 wherein the table top is circular.

* * * * *